US012590462B1

(12) United States Patent
Batten et al.

(10) Patent No.: US 12,590,462 B1
(45) Date of Patent: Mar. 31, 2026

(54) CONVERTIBLE SHADE SYSTEM

(71) Applicants: Joseph Batten, Sims, NC (US); William Jenkins, Sims, NC (US); Randy Jenkins, Lucama, NC (US); Alan Ray Howard, Wilson, NC (US)

(72) Inventors: Joseph Batten, Sims, NC (US); William Jenkins, Sims, NC (US); Randy Jenkins, Lucama, NC (US); Alan Ray Howard, Wilson, NC (US)

( * ) Notice: Subject to any disclaimer, the term of this patent is extended or adjusted under 35 U.S.C. 154(b) by 0 days.

(21) Appl. No.: 19/085,832

(22) Filed: Mar. 20, 2025

(51) Int. Cl.
*E04F 10/04* (2006.01)

(52) U.S. Cl.
CPC ..... *E04F 10/04* (2013.01)

(58) Field of Classification Search
CPC ..... E04F 10/0633; E04H 15/02; E04H 15/04; E04H 15/06; E04H 15/005; E04H 15/34; E04H 15/08; E04H 15/32
See application file for complete search history.

(56) References Cited

U.S. PATENT DOCUMENTS

| | | | | |
|---|---|---|---|---|
| 7,406,977 | B1 * | 8/2008 | Shires | E04H 15/26 135/121 |
| 7,841,356 | B2 * | 11/2010 | Shires | E04H 15/42 135/156 |
| 9,248,730 | B2 * | 2/2016 | Hu | B60J 11/04 |
| 10,378,234 | B1 * | 8/2019 | Nielsen | E04H 15/64 |
| 12,179,563 | B2 * | 12/2024 | Howard | E04H 15/06 |
| 2006/0108828 | A1 * | 5/2006 | Juola | E04H 15/06 296/159 |
| 2010/0212709 | A1 * | 8/2010 | Sotirkys | E04H 15/06 135/88.01 |
| 2014/0150836 | A1 * | 6/2014 | Bourland | E04H 15/44 135/96 |

FOREIGN PATENT DOCUMENTS

| | | | | |
|---|---|---|---|---|
| GB | 2540120 A | * | 1/2017 | E04H 15/06 |
| KR | 20240022137 A | * | 2/2024 | |
| WO | WO-0196693 A1 | * | 12/2001 | E04H 15/06 |

OTHER PUBLICATIONS

Machine translation KR20240022137 (Year: 2024).*
Trail Gear Oasis, video, Published Aug. 11, 2023, accessed from https://www.youtube.com/watch?v=uuqZQuv0P9s (Year: 2023).*
https://www.youtube.com/watch?v=61rsELtDRig, Accessed Dec. 9, 2025; Title "Trail Gear Oasis The Ultimate 2in1 Rain Cover & Shade for Your Jeep Wrangler 2Door Setup/ Use Guide;" Owner is Trail Gear Oasis.
https://www.youtube.com/watch?v=EYxO6yUv_kQ; Accessed Dec. 9, 2025; Title "Trail Gear Oasis SideKick Install | Step-by-Step Guide;" Owner is Trail Gear Oasis.

* cited by examiner

*Primary Examiner* — Abe Massad
*Assistant Examiner* — Jeremy C Ramsey
(74) *Attorney, Agent, or Firm* — Ashley D. Johnson; Dogwood Patent and Trademark Law

(57) ABSTRACT

The invention is a portable sunshade used in conjunction with and supported by a vehicle or other object (e.g., tree) to produce shade. The shade system includes a protective bag that houses a canopy that can be extended to provide shade from the sun. The system also includes a plurality of collapsible poles that cooperate to form frames that support the canopy during use. The bag can be releasably attached to a vehicle or any other support structure, allowing the shade system to be easily and quickly assembled in a variety of locations.

20 Claims, 9 Drawing Sheets

CONVERTIBLE SHADE SYSTEM

TECHNICAL FIELD

The presently disclosed subject matter is generally directed to a convertible shade that can be used with a wide variety of vehicles and/or supports. The shade can easily and quickly convert between storage and use configurations. The presently disclosed subject matter also includes methods of making and using the disclosed shade system.

BACKGROUND OF THE INVENTION

The popularity of outdoor activities has led to an increased demand and need for shelters that can be transported to a recreation site and easily set up to provide shade. These shelters are commonly used at beaches, sporting events, farmers markets, weddings, graduations, and other outdoor and indoor events. Portable umbrellas, canopies, and tents are often used, but suffer from many drawbacks. For example, conventional umbrellas provide limited protection based on the size and the circular shape of the umbrella. In addition, umbrellas are fragile and have the tendency to flip inside out in strong winds. Further, conventional canopies and tents require several individuals for assembly and often include multiple tie downs and anchors to prevent the canopies from blowing over. Prior art systems are also cumbersome to transport and/or assemble due to the number of parts involved, steps required during setup, and/or low shade to weight ratios.

It would therefore be beneficial to provide a portable shade that can be easily transported in the trunk or other available space of a vehicle and also easily assembled to provide a temporary shelter adjacent to a vehicle or other support structure (e.g., trees).

SUMMARY OF THE INVENTION

In some embodiments, the presently disclosed subject matter is directed to a shade assembly. Specifically, the assembly comprises a storage bag defined by a first end, an opposed second end, a body, and an interior, a closure positioned on a front face and one or more mounts position on a rear face. The shade assembly includes a canopy comprising a front, a rear edge, a pair of rear arms positioned on either side of the canopy rear edge, a pair of side edges positioned between the rear arms and the front, wherein the canopy rear edge is permanently attached to the interior of the storage bag, and wherein the canopy comprises a front sleeve defined by two open ends positioned at the canopy front and a pair of rear sleeves positioned at the canopy rear arms and configured such that each rear sleeve includes a closed end adjacent to the canopy rear edge. The shade assembly comprises a plurality of poles configured to interconnect and form a front frame and a pair of rear frames, wherein the front frame is configured to be removably housed within the front sleeve, and the pair of rear frames are configured to be removably housed within the rear sleeves.

In some embodiments, the shade assembly has a first configuration in which the canopy and poles are positioned within the bag interior, and a second configuration wherein the canopy extends from the bag interior by the attached rear edge and the poles are assembled into front frame and rear frames, the front frame positioned to extend through the front sleeve and the rear frames positioned to extend from the rear sleeves.

In some embodiments, the bag closure comprises one or more zippers, buttons, snaps, magnets, ties, clips, fasteners, or hook and loop elements.

In some embodiments, the mounts are configured as ties, zippers, magnets, hook and loop closure, or combinations thereof.

In some embodiments, the system includes about 1-10 mounts. The term "mount" includes any element that can releasably attach the bag to a support.

In some embodiments, the canopy is affixed to the bag interior via sewing, adhesive, or fasteners.

In some embodiments, the rear arms are angled relative to the rear edge at an angle of about 30, 35, 40, 45, 50, 55, 60, 65, or 70 degrees.

In some embodiments, the canopy has a length and width of about 2-20 feet and a thickness of about 0.05-1 inch.

In some embodiments, the poles are telescoping. The term "telescoping" refers to two parts of a device that are coupled together lengthwise, with one part entering, sliding, or passing within another part like the cylindrical sections of a collapsible hand telescope In some embodiments, the poles are interconnected end-to-end via an elastic cable.

In some embodiments, the system includes about 2-20 poles, each with a length of about 5-50 inches.

In some embodiments, the system includes one or more canopy attachments that cooperate with one or more ropes, straps, elastics, or sandbags. The term "sandbag" as used herein means a bag containing any "fill material."

In some embodiments, the presently disclosed subject matter is directed to a method of providing shade to a user. The method includes removing attaching the bag mounts of claim 1 to a support. The method includes removing a portion of the canopy from the bag interior wherein the rear edge of the canopy remains attached to the canopy interior and housed within the canopy interior. The method includes removing the plurality of poles from the bag interior. The method includes assembling a plurality of the poles into the front frame defined by a first end and a second end. The method includes positioning the front frame to extend through the canopy front sleeve and wherein the first and second ends extend into the ground in an arcuate shape. The method includes assembling a plurality of the poles into the rear frames, each rear frame defined by a first end and a second end. The method includes positioning each rear frame in a rear sleeve wherein the first end of each rear frame remains within an interior of the sleeve and the second end of each rear frame extends into the ground.

In some embodiments, the rear frames are configured in an arcuate shape in the ground.

In some embodiments, the support is a tree or a vehicle.

DETAILED DESCRIPTION OF THE INVENTION

Figure 1:
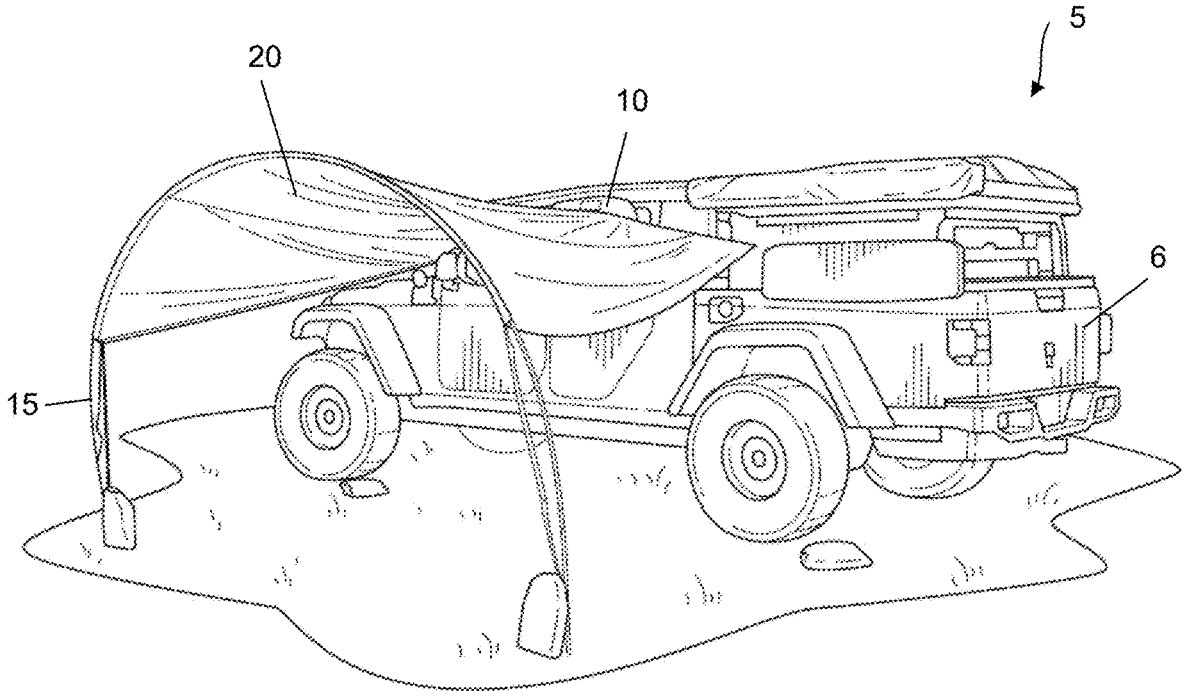
FIG. 1 is a perspective view of a shade system in use with a vehicle in accordance with some embodiments of the presently disclosed subject matter.

For the purposes of promoting an understanding of the principles of the present disclosure, reference will now be made to preferred embodiments and specific language will be used to describe the same. It will nevertheless be understood that no limitation of the scope of the disclosure is thereby intended, such alteration and further modifications of the disclosure as illustrated herein, being contemplated as would normally occur to one skilled in the art to which the disclosure relates.

Articles "a" and "an" are used herein to refer to one or to more than one (i.e., at least one) of the grammatical object of the article. By way of example, "an element" means at least one element and can include more than one element. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about." Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods. Thus, the term "about" is used to provide flexibility to a numerical range endpoint by providing that a given value may be "slightly above" or "slightly below" the endpoint without affecting the desired result.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any unclaimed element as essential to the practice of the invention.

Unless otherwise defined, all technical terms used herein have the same meaning as commonly understood by one of ordinary skill in the art to which this disclosure belongs.

The presently disclosed subject matter relates generally to sunshades, and in particular to a portable sunshade used in conjunction with and supported by a vehicle or other object (e.g., tree) to produce shade. As illustrated in FIG. 1, shade system 5 includes protective bag 10 that houses canopy 20 that can be extended to provide shade from the sun. The system also includes a plurality of collapsible poles 15 that cooperate to form a frame that supports the canopy during use. As described in detail below, bag 10 can be releasably attached to vehicle 6 or any other support structure, allowing the shade system to be easily and quickly assembled in a variety of locations.

Figure 2A:
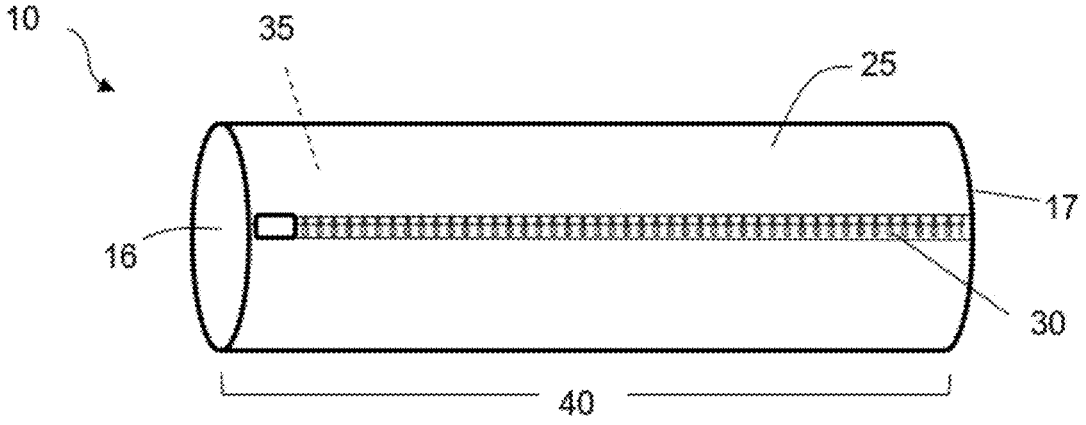
FIG. 2*a* is a perspective view of a shade system bag in accordance with some embodiments of the presently disclosed subject matter.

As noted above, shade system 5 includes outer bag 10 that can fully house the canopy and poles in a storage (or non-use) configuration. The term "bag" refers to any type of closeable container. As illustrated in FIG. 2*a*, the bag includes first end 16 and opposed second end 17 with body 25 therebetween. Bag 10 includes closure 30 that allows a user to access bag interior 35. Closure 30 can include any recloseable element such as (but not limited to) one or more zippers, buttons, snaps, magnets, ties, clips, fasteners, VELCRO®, and the like.

Bag 10 can have any desired cross-sectional shape, such as (but not limited to) circular, oval, square, rectangular, triangular, pentagonal, hexagonal, octagonal, and the like. Any shape can be used.

Figure 2B:
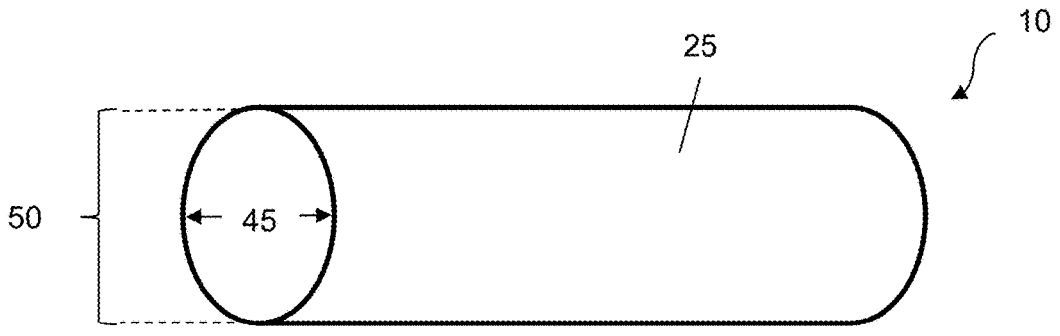
FIG. 2*b* a perspective view of a shade system bag in accordance with some embodiments of the presently disclosed subject matter.

The bag can be configured in a variety of sizes to accommodate larger and smaller sized canopies. For example, the bag can include length 40 of about 10-50 inches (e.g., at least/no more than about 10, 15, 20, 25, 30, 35, 40, 45, or 50 inches). The term "length" refers to the longest straight line distance between first and second ends 16, 17. Bag 10 can also include width 45 and/or height 50 of about 5-20 inches (e.g., at least/no more than about 5, 10, 15, or 20 inches). The term "width" refers to the longest straight line distance a front face or edge to an opposed rear face or edge of the bag, as shown in FIG. 2*b*. The term "height" refers to the longest straight line vertical distance from a top to an opposed bottom of the bag.

Figure 3A:
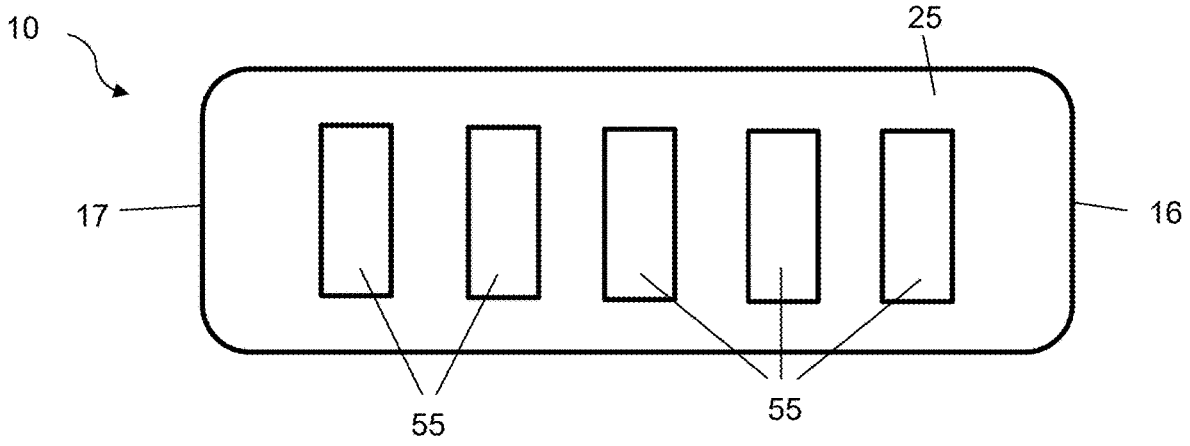
FIG. 3*a* is a rear view of a shade system bag in accordance with some embodiments of the presently disclosed subject matter.

As shown in FIG. 3*a*, the bag also includes a series of mounts 55 that can removably attach the bag to a surface, such as a vehicle window, tree, and the like. In some embodiments, mounts 55 can be positioned to oppose closure 30. For example, if the closure is on a front side or face of the bag, the mounts can be positioned on the rear side or face of the bag (e.g., opposite face). In this way, the mounts allow the bag to attach to a support (e.g., tree) and the closure can still be accessed to remove the canopy and poles.

Figure 3B:
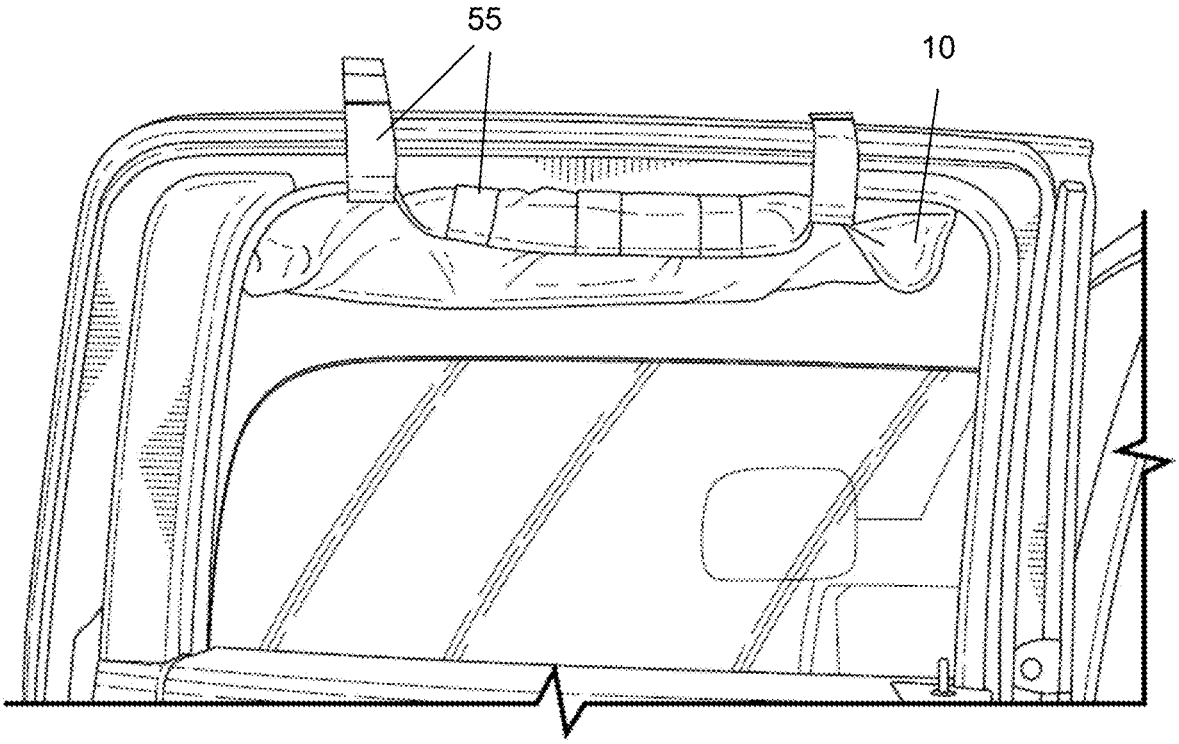
FIG. 3*b* is a front view of a shade system bag attached to a support in accordance with some embodiments of the presently disclosed subject matter.

In some embodiments, the mounts can be configured as a series of VELCRO® strips that can each independently open and close about a support (such as a vehicle open door/window), as shown in FIG. 3*b*. However, mounts 55 can include any recloseable element, such as ties, zips, magnets, and the like.

Bag 10 can include any number of mounts 55, such as about 1-10 or more (e.g., 1, 2, 3, 4, 5, 6, 7, 8, 9, 10, or more) in some embodiments.

The bag can be constructed from any desired material, such as (but not limited to) nylon, polymer (such polyethylene or polypropylene), plastic, polyester, polyester blend, cloth (such as canvas, hemp, flax, or cotton fiber), or combinations of these materials. In some embodiments, the material used to construct bag 10 can be waterproof or water-resistant. The term "waterproof" refers to the characteristic of being impervious to water or other liquid. The term "water resistant" refers to the ability to substantially but not fully prevent the penetration of water or other liquid. Suitable waterproof or water resistant materials or coatings can include (but are not limited to) polyvinyl chloride, urethane, urethane coated nylon, sealcoat, rubber, Gortex®, Hellytech®, ethylene vinyl acetate copolymer, latex, styrene-butadiene copolymer, vinyl, polyester, and the like.

Figure 4A:
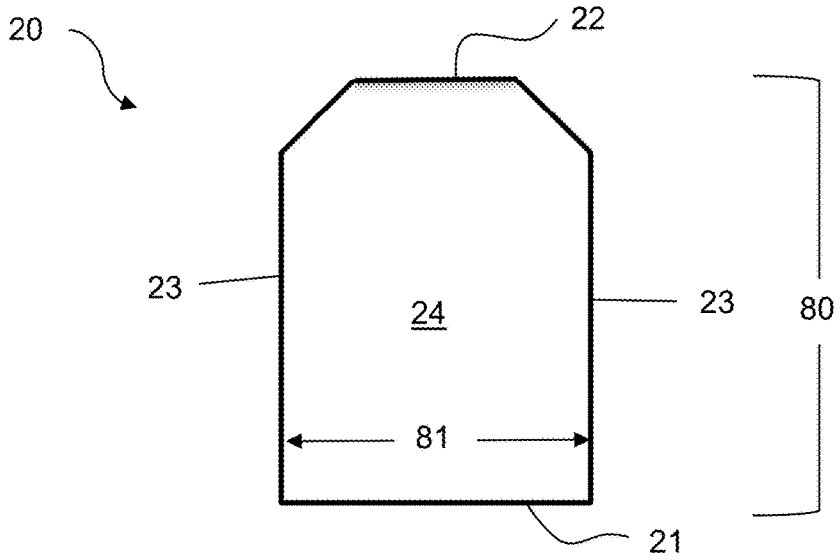
FIG. 4*a* is a top plan view of system canopy in accordance with some embodiments of the presently disclosed subject matter.
Figure 4B:
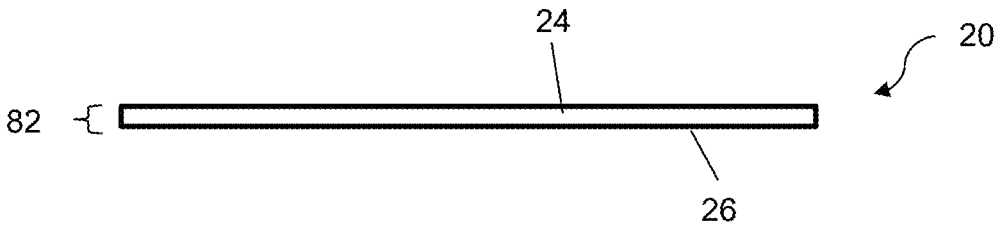
FIG. 4*b* is a front plan view of a system canopy in accordance with some embodiments of the presently disclosed subject matter.

In addition to bag 10, the disclosed system also includes canopy 20 configured for engagement with the bag and the poles. The term "canopy" broadly refers to any covering that is suspended or supported to provide shade and/or shelter to one or more people. One embodiment of canopy 20 is illustrated in FIGS. 4*a* and 4*b*. It should be appreciated that canopy 20 can be configured in any desired shape, such as square, rectangular, triangular, and the like. Thus, in some embodiments, canopy 20 includes front 21, rear 22, two opposite sides 23, top surface 24, and bottom surface 26.

Figure 4C:
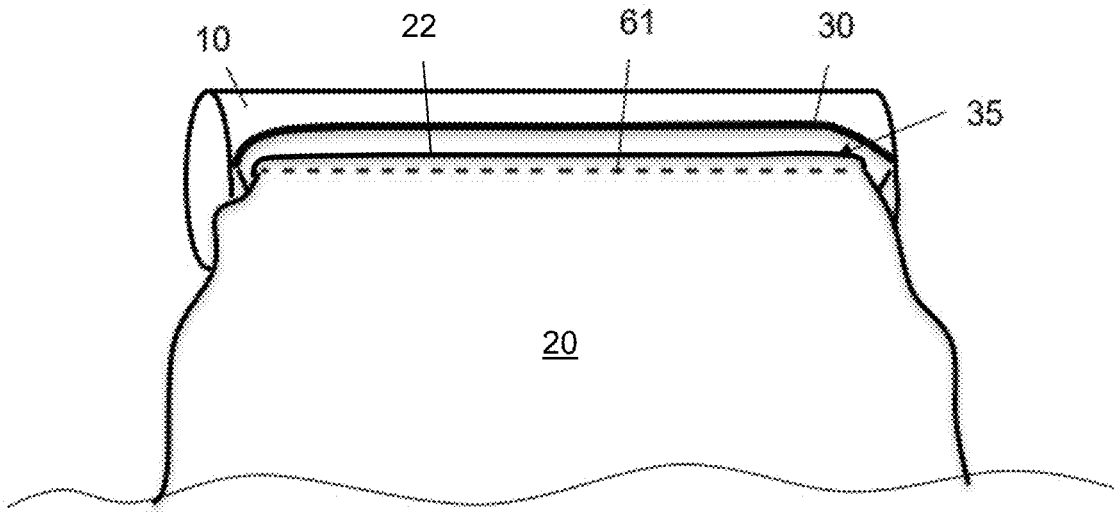
FIG. 4*c* is a perspective view of a system canopy attached to a bag interior in accordance with some embodiments of the presently disclosed subject matter.

As shown in FIG. 4*c*, rear 22 of the canopy can be configured as an edge that is permanently affixed to the interior 35 of bag 10 at attachment 61 using any method (e.g., sewing, adhesive, clips, fasteners, and the like). Thus, the remainder of the canopy can be folded up and stored within the interior of the bag with little to no risk of losing or misplacing it. The attachment of the rear of the canopy to the bag also provides a support during suspension, as described below.

Figure 4D:
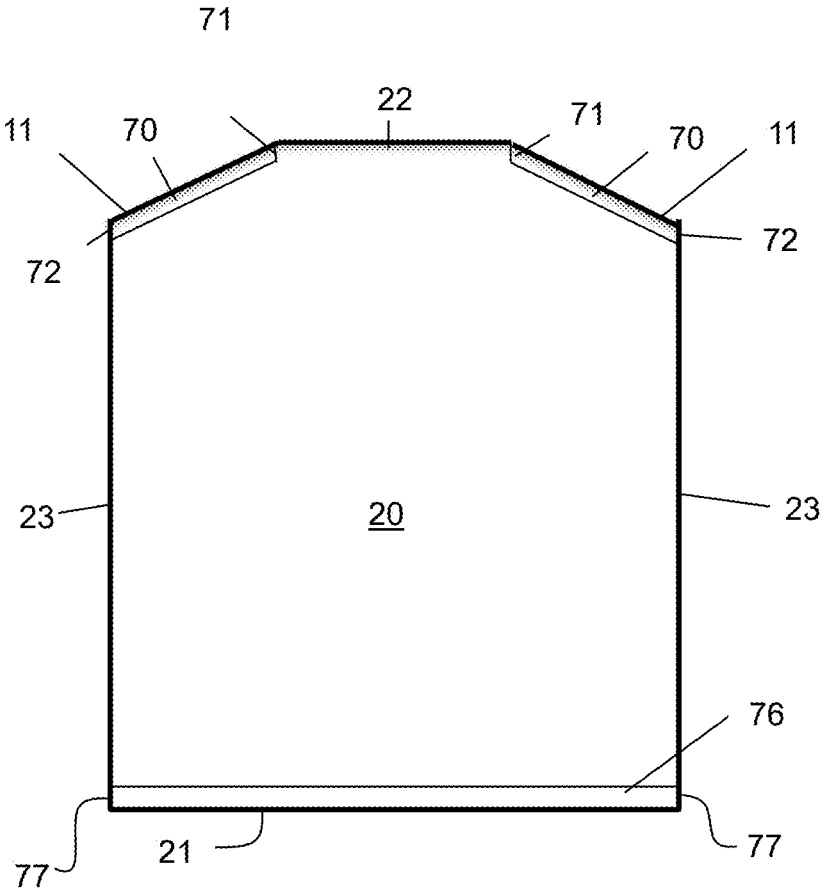
FIG. 4*d* is a top plan view of system canopy in accordance with some embodiments of the presently disclosed subject matter.

Canopy 20 also includes a plurality of sleeves that cooperate with the poles during use. As shown in FIG. 4*d*, the canopy includes front sleeve 76 at canopy front 21, between side edges 23. Distal ends 77 of the front sleeve are open (e.g., unsealed) to allow for insertion of one or more poles during use.

The canopy includes a pair of rear arms 11 positioned between rear 22 and side edges 23. Each rear arm includes rear sleeve 70 that runs the length of the arm edge. Rear sleeves 70 each include stop 71 positioned adjacent to rear edge 22 to ensure that the poles when assembled remain in position (e.g., the stops act as an end for sleeves 70). The stops can be a seam (e.g., sewn shut) in some embodiments. Rear sleeves 70 are open at distal ends 72 thereby allowing a pole to be inserted into the sleeve. The term "sleeve" broadly includes any type of channel or passage sized and shaped to accommodate poles 15.

Figure 4E:
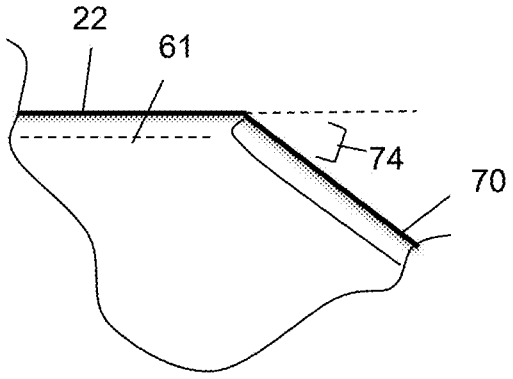
FIG. 4*e* is a fragmentary top plan view of a system canopy in accordance with some embodiments of the presently disclosed subject matter.

The rear arms are angled relative to the rear edge 22 as shown in FIG. 4*e*. For example, in some embodiments, the rear arms can have angle 74 of at least about 30 degrees relative to rear edge 22 (e.g., at least/no more than about 30, 35, 40, 45, 50, 55, 60, 65, or 70 degrees). Angle 74 is important to allow rear 22 to remain attached to the bag and also provide room and space to allow the rear arms to cooperate with poles 15, creating a rear and/or side portion of the shade.

Canopy 20 can be constructed from any desired material, such as (but not limited to) nylon, polymer (such polyethylene or polypropylene), plastic, polyester, polyester blend, cloth (such as canvas, hemp, flax, or cotton fiber), or combinations of these materials. In some embodiments, the canopy can be waterproof or water-resistant and thus can include one or more of polyvinyl chloride, urethane, urethane coated nylon, sealcoat, rubber, Gortex®, Hellytech®, ethylene vinyl acetate copolymer, latex, styrene-butadiene copolymer, vinyl, polyester, and the like. In some embodiments, the canopy can be constructed from a UV (ultraviolet) protective material.

The canopy can include length 80 and/or width 81 of about 2-20 feet (e.g., at least/no more than about 2, 3, 4, 5, 6, 7, 8, 9, 10, 11, 12, 13, 14, 15, 16, 17, 18, 19, or 20 feet) as shown in FIG. 4*a*. The canopy can also include thickness 82 of about 1 inch or less (e.g., 0.05, 0.1, 0.25, 0.5, 0.75, or 1 inch), as illustrated in FIG. 4*b*. However, the dimensions of the canopy are not limited. Thus, the canopy can be configured with a length, width, and thickness greater or less than the disclosed ranges.

Figure 5A:
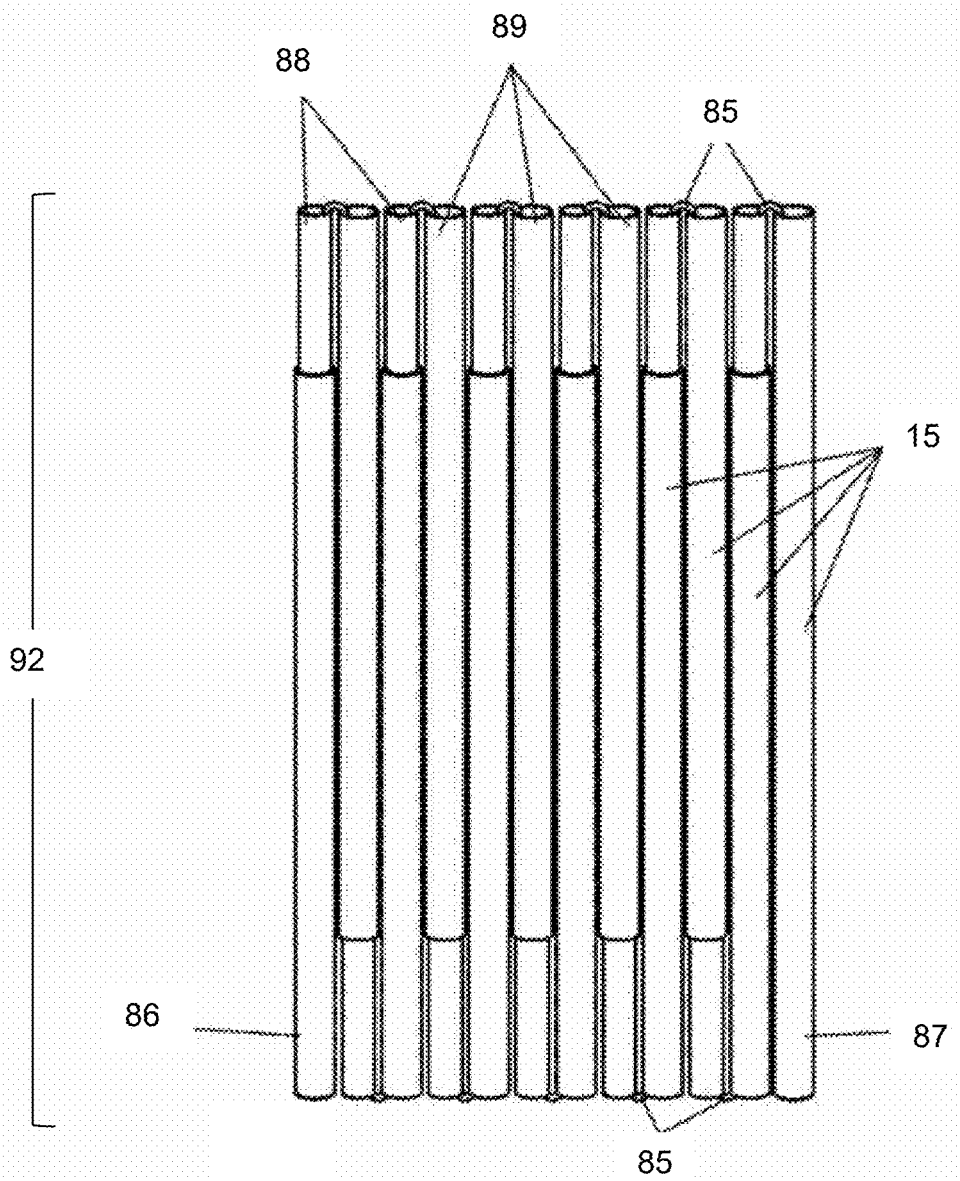
FIG. 5*a* is a top plan view of a plurality of system poles in accordance with some embodiments of the presently disclosed subject matter.

Shade system 5 also include a plurality of poles 15 that can be housed within bag interior 35 in the non-use configuration. The poles can be attached together and then applied through each sleeve as described. In some embodiments, the poles 15 are elastically interconnected, end-to-end via stretchable cable 85, as shown in FIG. 5*a*. However, any element can be used to attached adjacent poles, such as a spring, hinge device, or a slide collar that attaches the rigid poles together yet still allows them to be folded as shown.

In some embodiments, first pole 86 can define the left end of the assembled frame and a last pole 87 can define the right end of the frame. The first pole can include a single male end 88 or female end 89, with the other end being the left end.

The last pole 87 may similarly include a single male end or female end, with the other end being the right end of the assembled frame.

Figure 5B:
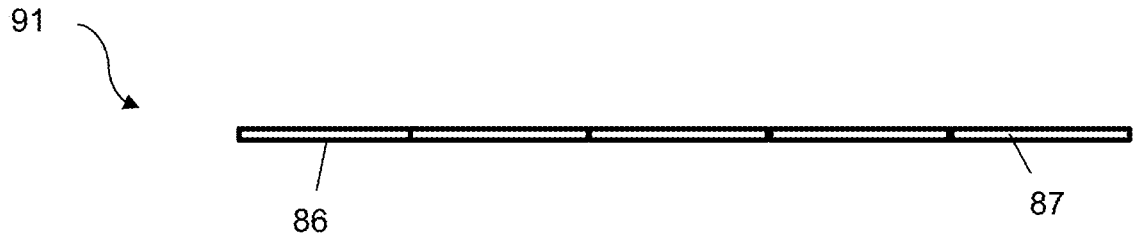
FIG. 5*b* is a side plan view of a plurality of system poles configured into a frame in accordance with some embodiments of the presently disclosed subject matter.

The frame is assembled by inserting the individual poles 15 into a continuous frame 91. For example, the male end of first pole 86 can be inserted into female end 89 of the second (e.g., directly adjacent) pole. Likewise, the male end of the second pole is inserted into the female end of the third (next) pole, and so forth until the last pole is reached. In this way a length of frame is assembled, as shown in FIG. 5*b*. Thus, the frame can include a plurality of poles 15 configured for end-to-end alignment from a left end to a right end of the frame. Frame 91 may be positioned to receive and support the canopy. In some embodiments, the poles are arranged telescopically, where each adjacent pole may be housed within and extend from each adjacent pole. In other embodiments, some or all of the poles include both a male end and a female end for engaging adjacent poles to each other to construct the supporting frame.

Frame 91 can be constructed from any number of individual poles 15 (e.g., about 2, 3, 4, 5, 6, 7, 8, 9, 10, 11, 12, 13, 14, 15, 16, 17, 18, 19, 20, or more). Each pole can have length 92 of about 5-50 inches (e.g., at least/no more than about 5, 10, 15, 20, 25, 30, 35, 40, 45, or 50 inches).

The frame can have any desired length. For example, suitable frame lengths can include (but are not limited to) about 3-10 feet. Thus, the frame can have a length of at least about (or no more than about) 3, 3.5, 4, 4.5, 5, 5.5, 6, 6.5, 7, 7.5, 8, 8.5, 9, 9.5, or 10 feet. However, the presently disclosed subject matter is not limited and the length of the frame can be larger or smaller than the range given herein.

As noted above, cable 85 can extend through the plurality of poles of the frame. In some embodiments, the cable can be elastic so that the poles can be maneuvered between a transport configuration (e.g., folded as shown in FIG. 5*a*) and a supporting configuration (e.g., assembled as shown in FIG. 5*b*), cable 85 can provide supporting tension to the end-to-end alignment of the assembled frame.

In use, poles 15 can be folded and housed within the interior of bag 10. Canopy 20 can also be folded and added to the interior of the bag. The bag can then be closed to retain all of the shade components securely within interior 35 (e.g., by zipping up a zipper). The shade system can then be stowed away for use at any desired time. For example, the storage configuration of the shade can be housed within a vehicle interior, attached to a backpack, or placed in a closet until needed.

Figure 6:
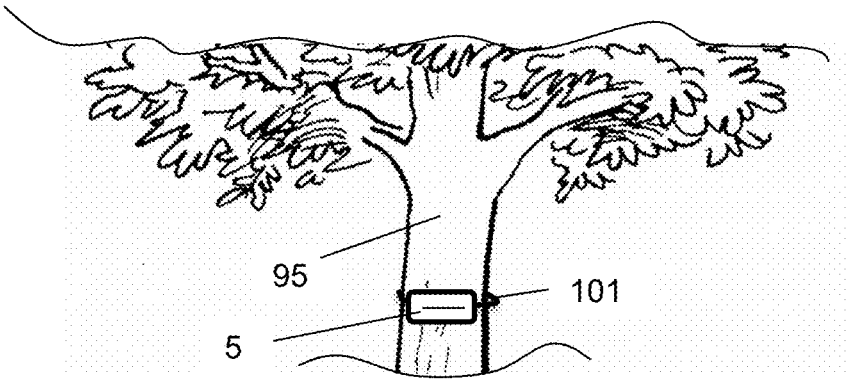
FIG. 6 is a front plan view of a shade system attached to a tree in accordance with some embodiments of the presently disclosed subject matter.

When a user desires to use shade system 5, bag 10 is first releasably attached to a support using one or more mounts 55, as shown in FIG. 3*b*. For example, each mount can be configured as a pair of tabs that each include the hook or loop of a hook and loop closure to releasably secure the two ends together around a support, such as the portion of a car door adjacent to an open window. The door can then be closed to anchor the bag and canopy rear end in place. Alternatively or in addition, a portion of rope 101 or other material can be strung through the mounts (e.g., the rope can be positioned between the mount and a rear face of the bag) to secure the bag to a tree 95 or other element, as shown in FIG. 6. In this way, the bag housing the poles and the canopy is maintained in a supported position. The tree or vehicle thereby help support the shade when in use. The term "vehicle" broadly refers to a device or structure for transporting animate or inanimate objects (e.g., persons and/or things), such as a self-propelled conveyance. Suitable vehicles can include (but are not limited to) cars, trucks, jeeps, vans, buses, campers, and the like.

Bag closure 30 can then be activated, allowing a user to access bag interior 35. The user can remove poles 15 from the bag interior, and the canopy. As noted above, rear 22 of the canopy remains permanently attached to the interior of the bag. The remainder of the canopy, however, can be pulled from the bag interior.

Figure 7A:
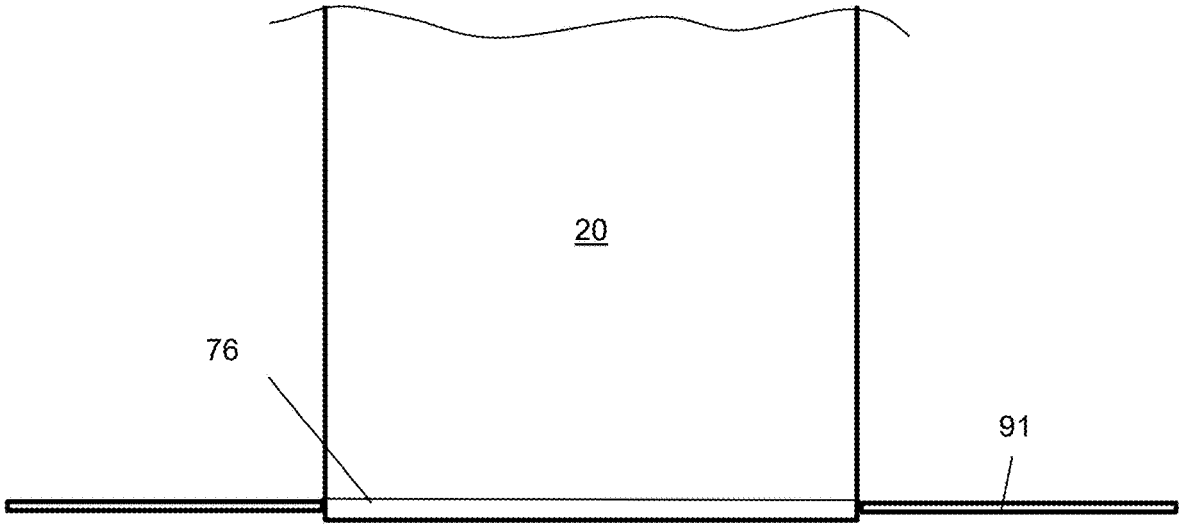
FIG. 7*a* is a top plan view of a frame positioned within a canopy front sleeve in accordance with some embodiments of the presently disclosed subject matter.
Figure 7B:
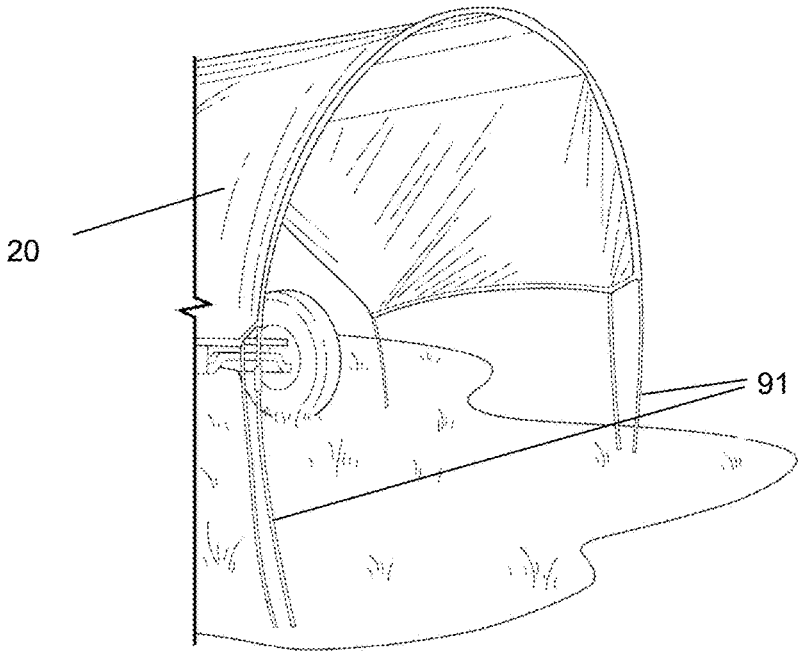
FIG. 7*b* is a perspective view of an assembled front frame positioned within a canopy front sleeve in accordance with some embodiments of the presently disclosed subject matter.

A desired number of poles 15 can then be assembled into a linear frame and inserted into front sleeve 76 of the canopy. Because ends 77 of the front sleeve are open, the assembled frame can be easily inserted through the sleeve, as shown in FIG. 7*a*. The front frame section can then be bent into an arcuate shape and inserted into the ground (e.g., sand, dirt, grass) as shown in FIG. 7*b*.

Figure 7C:
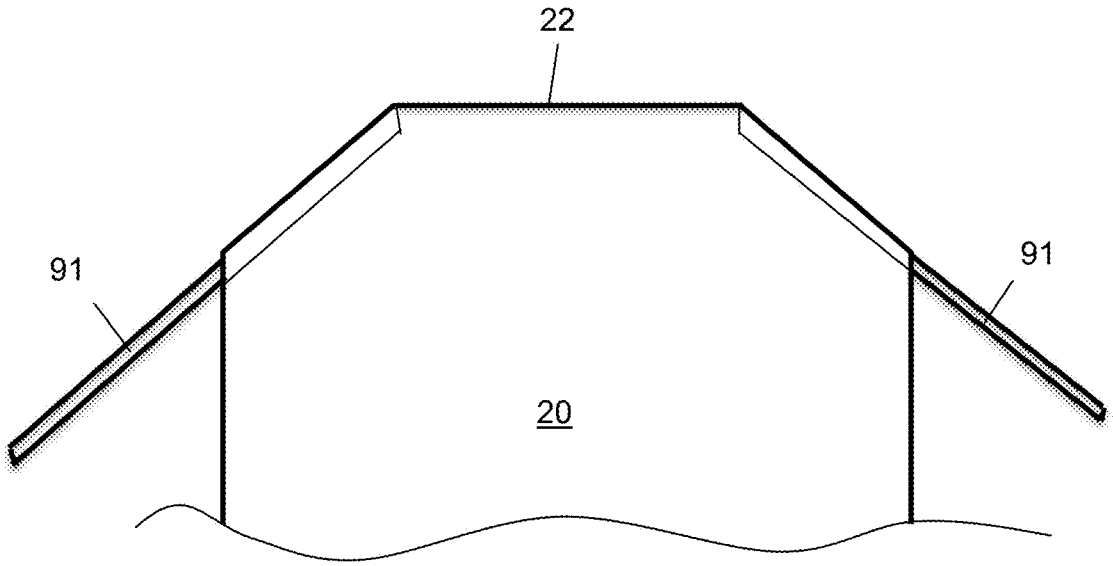
FIG. 7*c* is a top plan view of a pair of rear frames positioned within rear canopy sleeves in accordance with some embodiments of the presently disclosed subject matter.
Figure 7D:
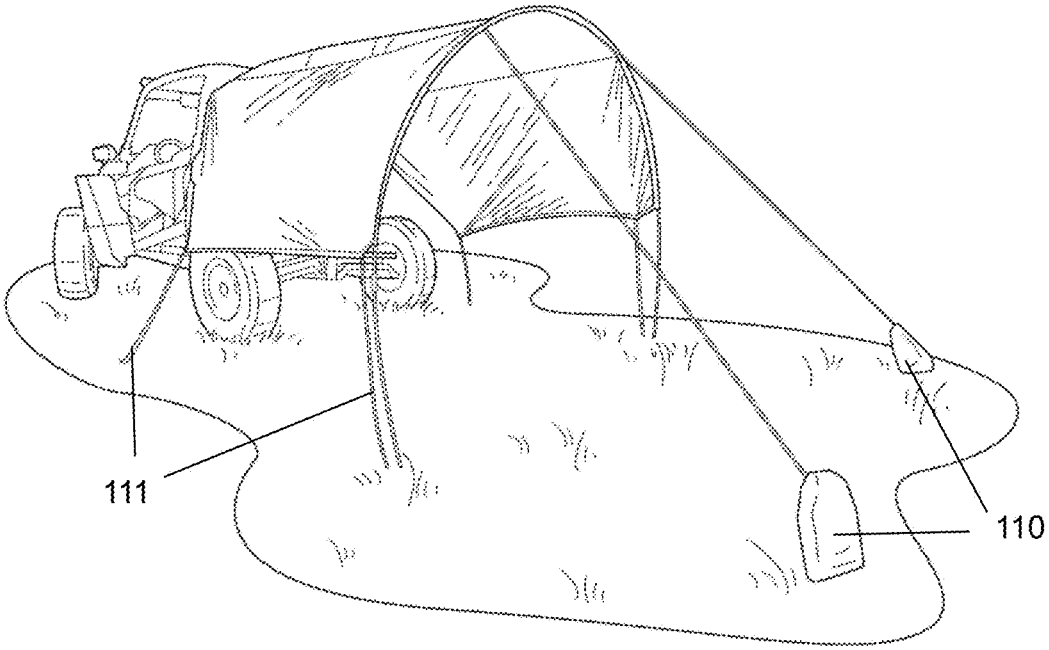
FIG. 7*d* is a perspective view of an assembled shade system in accordance with some embodiments of the presently disclosed subject matter.

Additional poles are also joined together and inserted into rear sleeves 70 of the canopy, as shown in FIG. 7*c*. Because of stops 71, one end of each frame will rest within the rear sleeve interior and the opposed frame end will extend from the sleeve as shown. The rear frames can also be curved into an arcuate shape as shown in FIG. 7*d*. However, the rear frames can maintain a straight or slightly bent configuration if desired.

The system frames therefore provide support for the front of the canopy. Rear 22 of the canopy is supported by attachment of bag 10 to the support structure. The remainer of the rear canopy is also supported by the rear frames that can also be positioned into the ground, sand, etc. In this way, system 5 can quickly and easily provide shade to a user by employing a vehicle or other element (e.g., tree) to assist in supporting the rear of the canopy to increase stability compared to prior art shade systems.

Optionally, the canopy can include one or more attachments 100 that allow counterweights to attach, further stabilizing the canopy. One or more bungee-type cords or straps 101 can connect to the attachment for additional anchoring of the system. Alternatively or in addition, the system can include one or more sandbags 110 that connect to the attachments, providing a counterweight, adding to the stability of the system. Sandbags 110 may be filled with sand, water, mud, dirt, etc., for the purpose of grounding the canopy and system 5 to a fixed position (similar to an anchor).

Users are then free to sit under the shade to get relief from the sun. When the shade is no longer needed, the steps are reversed to stow the shade in the storage configuration. Specifically, the frames are removed from the front and rear sleeves of the canopy and collapsed into the storage pole configuration. The canopy is then folded into the interior of the bag, along with the folded poles and the bag secured closed.

The disclosed system includes many benefits over prior art shades. For example, because canopy remains secured in a desired location, the user's views are not blocked. As a result, users can keep an eye on children and their belongings at all times.

The disclosed assembly is quiet compared to other umbrellas and sun shades. Specifically, canopy 20 does not loudly flap in the wind.

System 5 is also configured as a portable structure, allowing users to easily move the system to any desired location (e.g., the beach, the park, camping).

The disclosed system can be easily and quickly assembled or disassembled by a wide variety of users.

The disclosed system is lightweight and can be stored in a small space, such as the interior of a vehicle.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A shade assembly comprising:

a storage bag defined by a first end, an opposed second end, a body, and an interior, a closure positioned on a front face and one or more mounts positioned on a rear face, wherein the storage bag defines an enclosed interior configured to receive and store a canopy and a plurality of poles when not in use;

the canopy comprising a front, a rear edge, a pair of rear arms extending at an angle relative to the rear edge, and positioned on either side of the canopy rear edge, a pair of side edges positioned between the rear arms and the front, wherein the canopy rear edge is permanently attached to the interior of the storage bag such that the canopy is stowed entirely in and deployable directly from the bag interior, and wherein the canopy comprises a front sleeve defined by two open ends positioned at the canopy front and a pair of rear sleeves positioned at the canopy rear arms, each rear sleeve having a closed end adjacent to the canopy rear edge to limit pole travel; and the plurality of poles configured to interconnect and form a front frame and a pair of rear frames, wherein the front frame is configured to be removably housed within the front sleeve, and the pair of rear frames are configured to be removably housed within the rear sleeves.

2. The shade assembly of claim 1, wherein the shade assembly has a first configuration in which the canopy and poles are positioned within the bag interior, and a second configuration wherein the canopy extends from the bag interior by the attached rear edge and the poles are assembled to form the front frame and rear frames, the front frame positioned to extend through the front sleeve and the rear frames positioned to extend from the rear sleeves.

3. The shade assembly of claim 1, wherein the bag closure comprises one or more zippers, buttons, snaps, magnets, ties, clips, fasteners, or hook and loop elements.

4. The shade assembly of claim 1, wherein the mounts are configured as ties, zippers, magnets, hook and loop closure, or combinations thereof.

5. The shade assembly of claim 1, comprising about 1-10 mounts.

6. The shade assembly of claim 1, wherein the canopy is affixed to the bag interior via sewing, adhesive, or fasteners.

7. The shade assembly of claim 1, wherein the rear arms are angled relative to the rear edge at an angle of about 30, 35, 40, 45, 50, 55, 60, 65, or 70 degrees.

8. The shade assembly of claim 1, wherein the canopy has a length and width of about 2-20 feet and a thickness of about 0.05-1 inch.

9. The shade system of claim 1, wherein the poles are telescoping.

10. The shade system of claim 1, wherein the poles are interconnected end-to-end via an elastic cable.

11. The shade system of claim 1, comprises about 2-20 poles, each with a length of about 5-50 inches.

12. The shade system of claim 1, further comprising one or more canopy attachments that cooperate with one or more ropes, straps, elastics, or sandbags.

13. A method of providing shade to a user, the method comprising:

removably attaching the mounts of the shade assembly of claim 1 to a support; removing a portion of the canopy from the bag interior wherein the rear edge of the canopy remains attached to the canopy bag interior and housed within the canopy bag interior;

removing the plurality of poles from the bag interior;

assembling a plurality of the poles into the front frame defined by a first end and a second end;

positioning the front frame to extend through the canopy front sleeve and wherein the first and second ends extend into the ground in an arcuate shape;

assembling a plurality of the poles into the rear frames, each rear frame defined by a first end and a second end;

positioning each rear frame in a respective one of the rear sleeves wherein the first end of each rear frame remains within an interior of the respective sleeve and the second end of each rear frame extends into the ground.

14. The method of claim 13, wherein the rear frames are configured in an arcuate shape in the ground.

15. The method of claim 13, wherein the support is a tree or a vehicle.

16. The method of claim 13, wherein the mounts are configured as ties, zippers, magnets, hook and loop closure, or combinations thereof.

17. The method of claim 13, wherein the canopy has a length and width of about 2-20 feet and a thickness of about 0.05-1 inch.

18. The method of claim 13, wherein the poles are telescoping.

19. The method of claim 13, wherein the poles are interconnected end-to-end via an elastic cable.

20. The method of claim 13, comprises about 2-20 poles, each with a length of about 5-50 inches.

* * * * *